US006293368B1

(12) United States Patent
Ylinen et al.

(10) Patent No.: US 6,293,368 B1
(45) Date of Patent: Sep. 25, 2001

(54) GENETIC PROCEDURE FOR MULTI-DECK ELEVATOR CALL ALLOCATION

(75) Inventors: Jari Ylinen; Tapio Tyni, both of Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/599,872

(22) Filed: Jun. 23, 2000

Related U.S. Application Data

(63) Continuation of application No. PCT/FI98/01015, filed on Dec. 23, 1998.

(30) Foreign Application Priority Data

Dec. 23, 1997 (FI) ..... 974613

(51) Int. Cl.[7] ..... B66B 1/18
(52) U.S. Cl. ..... 187/382; 187/902; 706/910
(58) Field of Search ..... 117/380, 382, 117/910, 902, 247; 706/13, 21, 902, 903, 910

(56) References Cited

U.S. PATENT DOCUMENTS

| | | | | |
|---|---|---|---|---|
| 4,993,518 | | 2/1991 | van Straaten et al. . | |
| 5,239,141 | * | 8/1993 | Tobita et al. | 706/910 |
| 5,394,509 | * | 2/1995 | Winston | 395/13 |
| 5,612,519 | * | 3/1997 | Chenais | 187/382 |
| 5,767,461 | * | 6/1998 | Nakagawa et al. | 187/382 |
| 5,848,403 | * | 12/1998 | Gabriner et al. | 706/13 |
| 5,907,137 | * | 5/1999 | Tyni et al. | 187/382 |
| 5,932,852 | * | 8/1999 | Tyni et al. | 187/382 |
| 6,000,504 | * | 12/1999 | Koh et al. | 706/910 |

FOREIGN PATENT DOCUMENTS

| | | |
|---|---|---|
| B32893 | 3/1985 | (AU) . |
| 0709332 | 5/1996 | (EP) . |
| 9633123 | 10/1996 | (WO) . |

* cited by examiner

*Primary Examiner*—Jonathan Salata

(57) ABSTRACT

Genetic procedure for the allocation of calls issued via the landing call devices of elevators included in a multi-deck elevator group, in which procedure a multi-deck elevator model is formed in which the limitations of and rules of behaviour for each elevator in the multideck elevator group and each car of each elevator are defined; a plurality of allocation options, i.e. chromosomes are formed, each of which contains a car data item and an elevator direction data item for each active landing call, and these data, i.e. genes, together define a car to serve each landing call as well as a collective control direction for the elevator; for each chromosome, a fitness function value is determined; one or more of the chromosomes are selected and altered in respect of at least one gene; fitness function values are determined for the new chromosomes; the process of altering the chromosomes, selecting chromosomes and determining fitness functions is continued until a termination criterion is met and, based on the fitness function values, the most suitable chromosome is selected and the calls are allocated to the elevators and cars in the elevator group in accordance with this solution.

13 Claims, 4 Drawing Sheets

Figure 1:
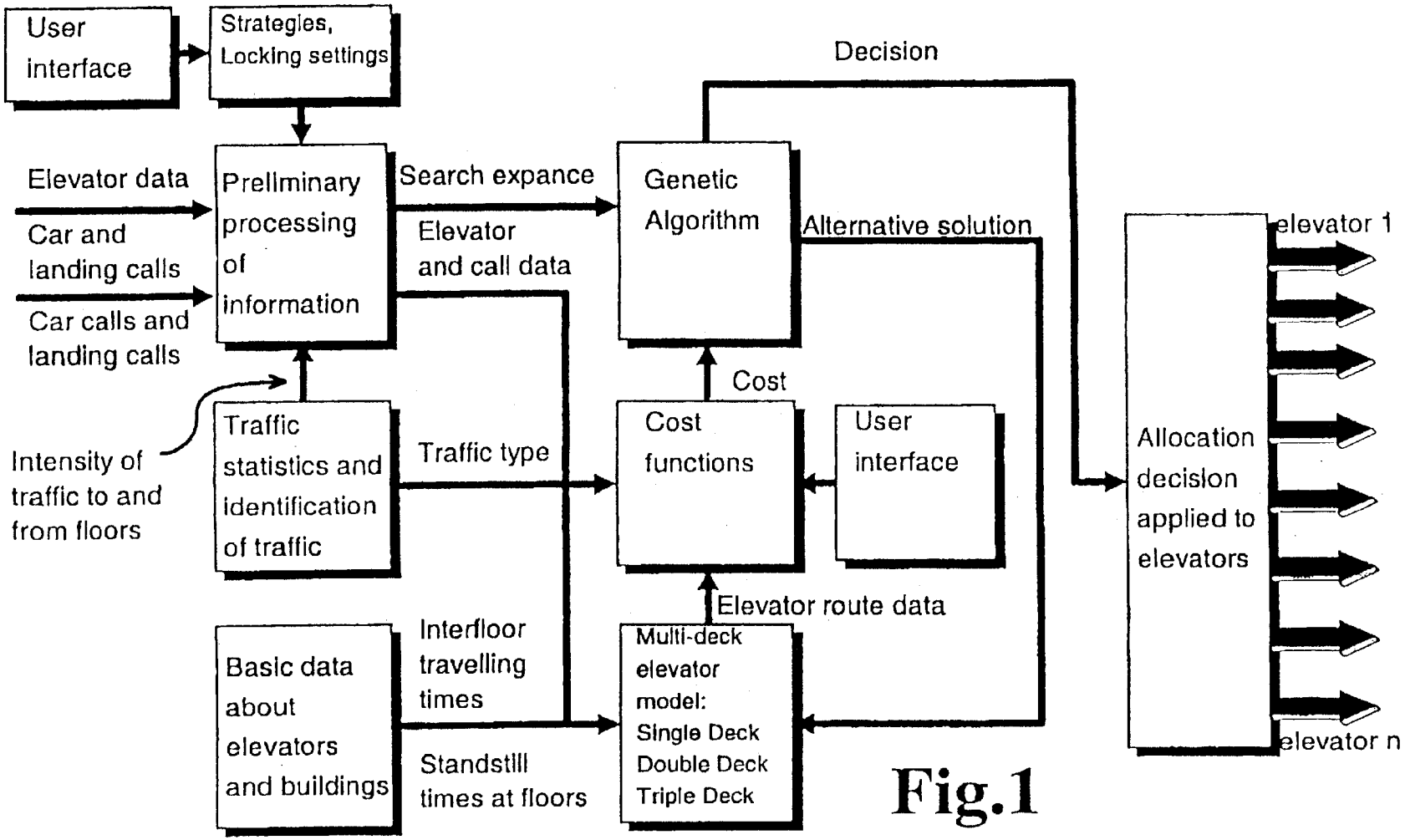

| | | | |
|---|---|---|---|
| Upper car | Upper car | Locked | Upper car |
| Upper Car Lower Car | Lower Car | Locked | Lower Car |
| Upper Car Lower Car | Upper car | Locked | Locked |
| Upper Car Lower Car | Lower Car | Locked | Locked |
| Upper Car Lower Car | Upper car | Locked | Locked |
| Upper Car Lower Car | Lower Car | Locked | Upper car |
| Upper Car Lower Car | Upper car | Upper car | Upper Car Lower Car |
| Upper Car Lower Car | Lower Car | Upper Car Lower Car | Lower Car |
| Upper Car Lower Car | Upper car | Upper Car Lower Car | Locked |
| Upper Car Lower Car | Lower Car | Upper Car Lower Car | Locked |
| Upper Car Lower Car | Upper car | Upper Car Lower Car | Upper car |
| Lower Car | Lower Car | Lower Car | Lower Car |

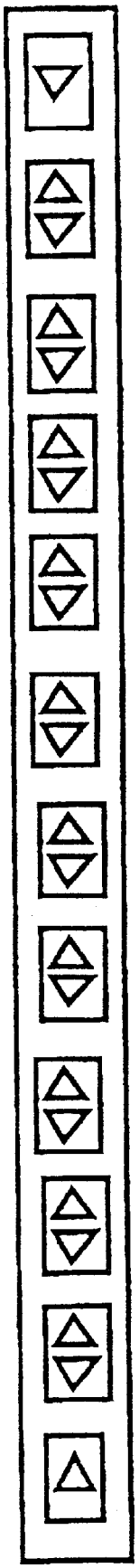

Fig.4

GENETIC PROCEDURE FOR MULTI-DECK ELEVATOR CALL ALLOCATION

This application is a Continuation of PCT International Application No. PCT/FI98/01015 filed on Dec. 23, 1998, which designated the United States and on which priority is claimed under 35 U.S.C. § 120, the entire contents of which are hereby incorporated by reference.

The present invention relates to a genetic procedure for the control of an elevator group.

When a passenger wants to have a ride in an elevator, he/she calls an elevator by pressing a landing call button on the floor in question. The elevator control system receives the call and tries to figure out, which one of the elevators in the elevator bank can serve the call best. This activity is termed call allocation. The problem to be solved by call allocation is to establish which one of the elevators is to serve each call so as to minimise a preselected cost function.

Traditionally, to establish which one of the elevators will be suited to serve a call, the reasoning is performed individually in each case by using complex condition structures. Since the elevator group has a complex variety of possible states, the condition structures will also be complex and they often have gaps left in them. This leads to situations in which the control system does _not function in the best possible way. Furthermore, it is difficult to take the entire elevator group into account as a whole.

Finnish patent application FI 951925 presents a procedure for the allocation of landing calls in an elevator group, in which some of the problems described above have been eliminated. This procedure is based on forming a plurality of allocation options, each of which comprises a call data item and an elevator data item for each active landing call, and these data together define the elevator to serve each landing call. After this, the value of a cost function is computed for each allocation option and one or more of the allocation options are repeatedly altered with respect to at least one of the data items comprised in it, whereupon the values of the cost functions of the new allocation options thus obtained are computed. Based on the values of the cost functions, the best allocation option is selected and active elevator calls are allocated accordingly to the elevators in the elevator group.

The solution presented in the above application substantially reduces the required calculation work as compared with having to. calculate all possible route alternatives. In this procedure, which is based on a genetic algorithm, the elevator group is treated as a whole, so the cost function is optimised at the group level. The optimisation process need not be concerned with individual situations and ways of coping with them. By modifying the cost function, desired operation can be achieved. It is possible to optimise e.g. passenger waiting time, call time, number of starts, travelling time, energy consumption, rope wear, operation of an individual elevator if. using a given elevator is expensive, uniform use of the elevators, etc., or a desired combination of these.

In order to further increase the efficiency and capacity of elevator groups, elevator systems have been developed in which two or even three cars placed on top of each other travel in the same elevator shaft. Such elevators are called double-deck or triple-deck elevators.

In prior art, if landing calls were only served by double-deck elevators, then after the decision regarding the selection of an elevator it would be necessary to make a second decision about which one of the two decks is to serve the landing call. For the latter decision, it is necessary to have rules which must take the whole elevator group into account and which must be comprehensive if the control system is to find an optimal solution in respect of a desired, alterable cost function. In addition, the selection rules must be applicable for use directly in any elevator group configuration and in any traffic situation.

The object of the present invention is to eliminate the drawbacks described above. A specific object of the present invention is to disclose a new type of procedure that enables allocation of calls given via landing call devices of elevators comprised in a multi-deck elevator group. In this context, multi-deck elevator group means an elevator group that comprises at least one multi-deck elevator, possibly several single-deck, double-deck and triple-deck elevators in the same elevator bank.

The genetic procedure of the invention for the control of a multi-deck elevator group is based on the insight that although the same elevator may comprise several cars, these can initially be regarded as separate cars, and a suitable car is allocated to serve each landing call. This makes it possible to avoid making decisions at two levels as mentioned above. However, as the cars in the same elevator are not independent of each other, the interaction between them will be taken into account when. a car selection alternative is input to a multi-deck elevator model in which the cars are associated with the elevators to which they belong.

In the genetic procedure of the invention, a multi-deck elevator model is formed in which the limitations of and rules of behaviour for each elevator in the multi-deck elevator group and each car of each elevator are defined. After this, a number of allocation options, i.e. chromosomes are formed, each of which contains a car data item and an elevator direction data item for each active landing call, and these data, i.e. genes, together define a car to serve the landing call as well as the collective control direction for the elevator. For the chromosomes thus generated, fitness function values are determined, and one or more of the chromosomes are selected, which are then altered in. respect of at least one gene. For the new chromosomes thus obtained, fitness function values are determined, and the process of forming chromosome mutations and selecting chromosomes and determining fitness functions is continued until a termination criterion is met. After this, based on the fitness function values, the most suitable chromosome is selected and the calls are allocated to the elevators and cars in the elevator group in accordance with this solution.

Thus, in multi-deck group control according to the invention, decision-making is based on route optimisation effected using a genetic algorithm. In the route optimisation, each landing call is served. A problem in the route optimsation is exponential increase of the number of alternative solutions as the number of landing calls increases. The multi-deck system further increases the number of alternative solutions if the elevators are treated as separate cars. For this reason, the number of alternatives and the computation power needed soon become too large even in small multi-deck elevator groups. A genetic algorithm substantially reduces the computation work needed, because it can select a solution without systematically working through all the alternative solutions. In addition, it is of a parallel structure by nature, so the computation work can be divided among several processors.

The genetic algorithm of the invention operates with a set of alternative solutions whose ability to solve the problem is developed until the termination criterion for the optimisation is met. The fitness of each alternative solution to become a control decision depends on the value it is assigned after it has been processed in the elevator model and its cost has been calculated using a desired cost function. The termination criterion may consist of e.g. a predetermined fitness function value obtained, a number of generations, an amount of processing time or a sufficient homogeneity of the population.

Thus, in the optimisation method of the invention, the first task is to define a search expanse in which the extent of the problem is described and the limitations for optimisation are set. The resources, the limlitations and the prevailing traffic situation together form an elevator model or an operating environment in which the group controller must perform its function in the best manner possible in accordance with the task assigned to it. At any given point of time, the operating environment may thus comprise e.g. the number of elevators together with car sizes and degrees of occupancy, factors relating to the drives such as travelling times between floors, door open times and amounts of traffic from and to different floors, active landing and car calls. and the limitations imposed by special group control functions active. A predetermined or desired control strategy or control method may also function as a limiting factor for the genetic group controller.

In multi-deck control, the working principles are established in the control logic in advance e.g. by developing rules as to which one of the elevator cars is to serve a landing call encountered or by developing control strategies, such as e.g. having the lower cars of double-deck elevators serve odd floors and the upper cars—even floors. A feature common to these control methods is that they involve a decision as to which ones of the cars of multi-deck elevators may serve landing calls issued from a given floor, thus contributing towards increasing the flexibility of the controller and optimising the control decisions it makes.

After the formation of a search expanse, a first set of alternative solutions or allocation options, i.e. a first population, is created. This set may also include both earlier solutions and solutions generated by other methods. As the first allocation options, i.e. chromosomes, may be the result of completely arbitrary selection, they are usually very different in respect of their fitness values. The first set is also called a first population. The first population is improved via genetic operations, which include e.g. various selection, hybridisation and mutation techniques as well as elitism strategies. By these techniques, new generations, i.e. sets of alternative solutions are created. For each new alternative solution, a fitness function value is calculated, whereupon a new round of selection and creation is started.

Since the selection is based on the fitness function values, this activity results in eliminating bad solutions as generations pass. At the same time, the features comprised in the better solutions are increased and propagated to the level of the entire population. thus generating better and better control decisions. This process of improving alternative solutions is continued until the criterion for terminating the optimisation is fulfilled. From the best alternative solution, i.e. chromosome, among the last generation created, the genetic multi-deck group controller then produces a control decision for the current traffic situation.

The alternative control decisions are arranged into models forming chromosomes in the genetic control algorithm, so-called multi-deck control chromosomes. A control chromosome represents the way in which the elevator group as a whole will serve the traffic in the building at a given instant of time within the framework of different limitations and resources. The control chromosomes consist of genes, of which there are two types: car genes and direction genes. These together identify the one of the cars in the elevator group that is to serve each landing call and the direction in which stationary elevators with no direction selected are to start out to serve landing calls allocated to them or to their individual cars.

The value of a car gene indicates which one of the cars in the multi-deck elevator group is to serve the landing call corresponding to the gene. In the decision-making process, the alternative values, i.e. alleles, and the range of values of the gene depend on which ones of the individual cars of the elevators in the elevator group are able to serve the landing call in question within the framework of the various prevailing limitations, such as. locked-out floors. The number of car genes in a chromosome varies from one instant to the next, depending on the number of active landing calls issued. In addition, the number of genes may also be influenced by anticipated landing calls likely to be received in the near future.

When no collective control direction has been defined for the elevator, it is necessary to decide whether the elevator is to start moving in the up or down direction first to serve the landing calls allocated to it. The decision about the direction has an effect on the group control service capacity, and the decision must be dependent at least on the current traffic situation. A direction gene for an elevator is included in the chromosome when it is necessary to decide about the direction in which an unoccupied elevator is to start out to serve the calls allocated to it. When this decision is made simultaneously with the car decision, the controller will have more freedom and is therefore also more likely to make better control decisions as compared with forming the decisions about the direction in advance by the application of various rules. Moreover, the entire elevator group is automatically taken into account as a whole.

A control chromosome, i.e. a decision alternative, consists of car and direction genes. In a traffic situation, it is necessary to determine the number of each type of gene in the chromosome as well as the alleles, i.e. alternative values of the genes. At the same time, their ranges of values are obtained. The position of a gene in the chromosome corresponds to an active landing call or a landing call to appear in the near future or to an elevator-specific direction gene. Depending on the type of the gene, its content determines which one of the cars of the multi-deck elevator is to serve the landing call in question or in which direction the elevator is to start out to serve the landing calls. The contents, i.e. values, of the genes in a chromosome determine how well the chromosome can solve the current control problem.

The multi-deck elevator model used in the procedure of the invention may contain a single-deck elevator model, which defines the limitations of and rules of behaviour for single-deck elevators, a double-deck elevator model, which defines the limitations of and rules of behaviour for double-deck elevators, and a triple-deck elevator model, which defines the limitation s of and rules of behaviour for triple-deck elevators. In double-deck and triple-deck elevator models, it is generally assumed that the cars of the elevator are fixedly connected to each other, i.e. that they always move at the same time in the same direction in the elevator shaft. However, this is not necessary in the genetic procedure of the invention, which can be used even.with elevator models in which the cars move separately in the same shaft. In this case, of course, the limitations between cars differ considerably from the case where the cars move together.

The genetic procedure of the invention is a flexible solution as a control system for elevator groups because the control system can be given complete freedom to use the cars in the elevator group in the best possible manner in any given traffic situation because the controller is not bound to follow any predetermined control strategy, on the other hand, the procedure of the invention is capable of implementing all known principles applied in double-deck group control by limiting the use of the cars by the controller in serving landing calls, in accordance with a desired strategy, the behaviour of the elevator group can be easily influenced by selecting a desired optimisation criterion, such as e.g. waiting time, energy consumption or a combination of these, the procedure is capable of utilising traffic information produced by traffic forecasts, the choice between different control principles and optimisation criteria can easily be made available to the user, the procedure can be used to control elevator groups comprising any numbers of single-deck, double-deck and triple-deck elevators.

Figure 2:
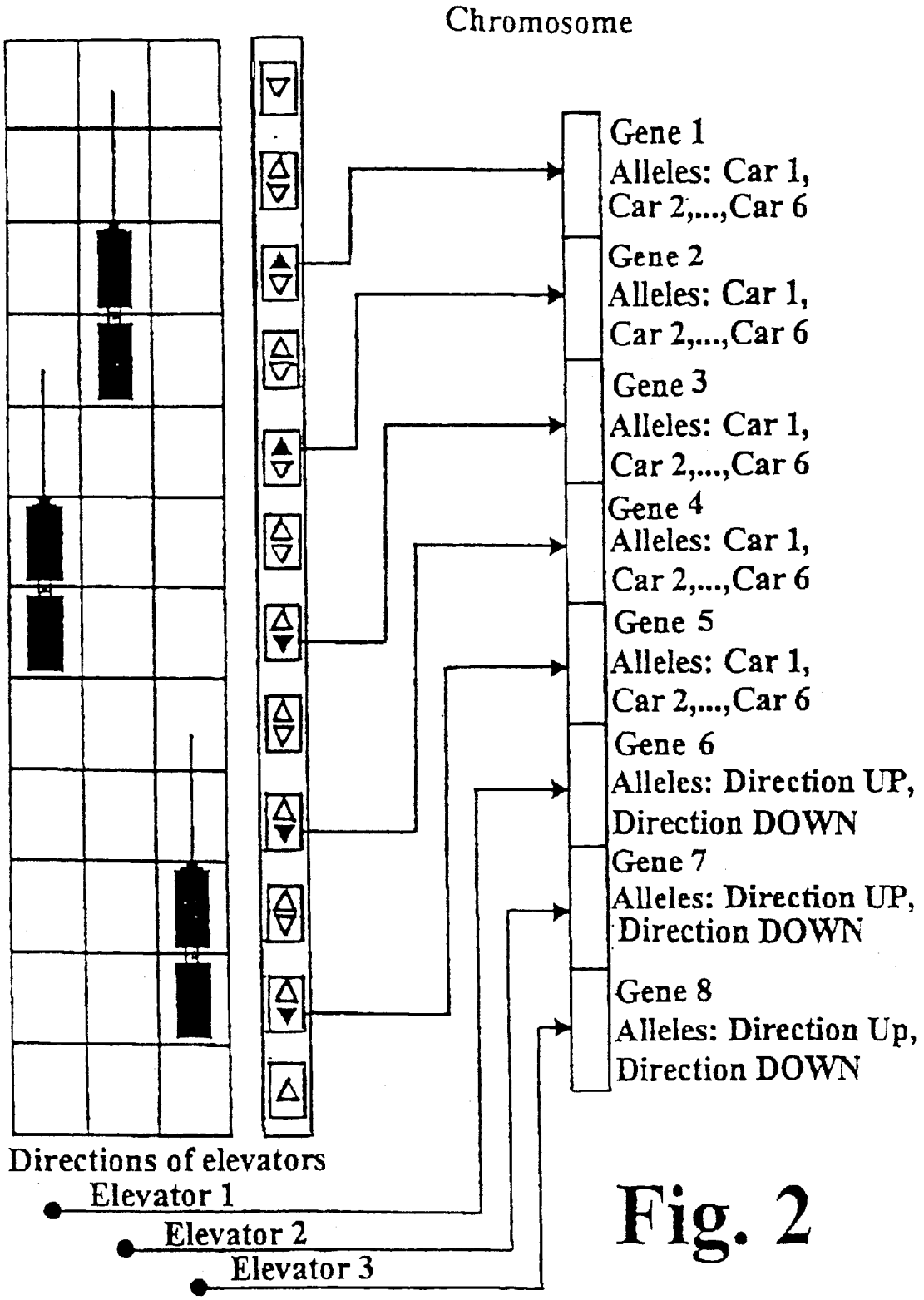
Figure 3:
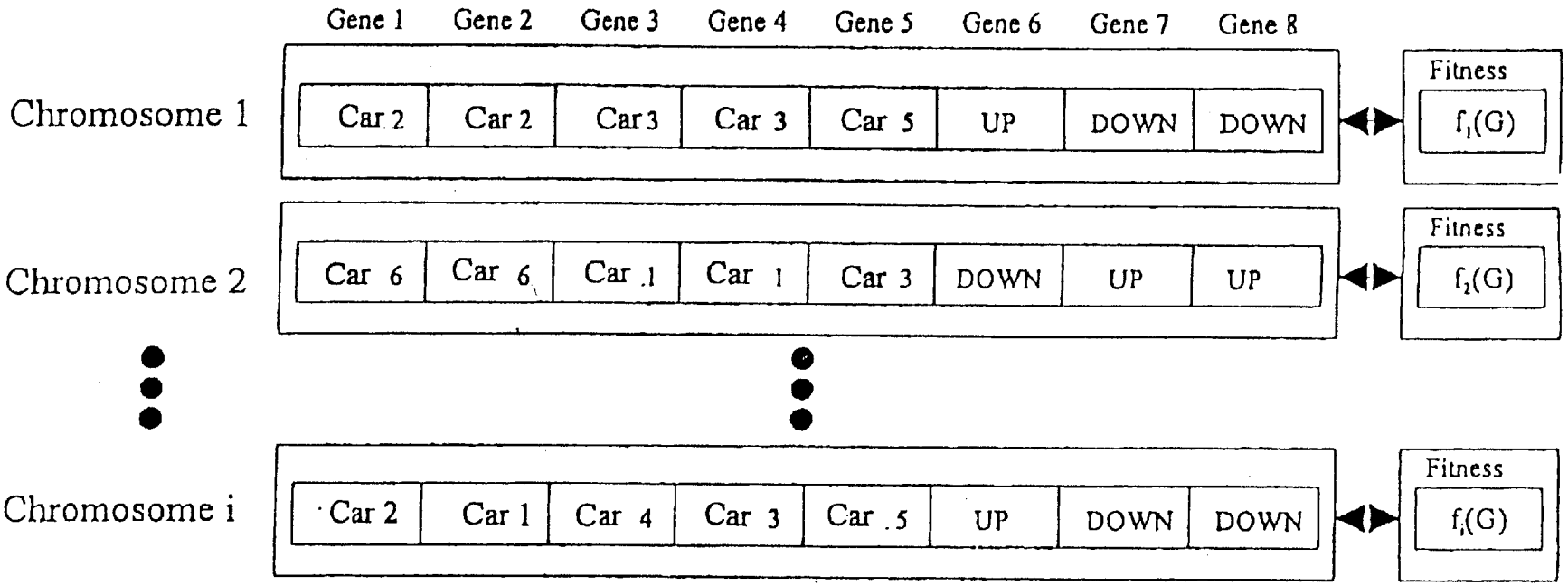

In the following, the invention will be described in detail by referring to the attached drawings, wherein FIG. 1 is diagram representing a multi-deck control system according to the invention, FIG. 2 illustrates the formation of the gene structure of a chromosome in a certain type of traffic situation, FIG. 3 presents a population of different control chromosomes for the traffic situation represented by FIG. 2, and FIG. 4 represents a service configuration in the case of a certain type of double-deck elevator group.

The main blocks of a genetic multi-deck control system as illustrated by FIG. 1 are a preliminary data processing system and a genetic decision-making mechanism consisting of a genetic algorithm, an elevator model and one or more cost functions. The arrows between the components represent the flow of information.

The genetic procedure of the invention aims at finding the best control decision optimised for the traffic situation prevailing at the current instant. The optimisation is performed among a set of possible alternative solutions, taking various limitations into account. The set of alternative solutions is also called search expanse. In practice, the search expanse indicates which combinations of control decisions are feasible, i.e. in genetic multi-deck control it indicates e.g. which ones of the elevators can be used to serve passengers on each floor with landing calls active. For example, if there is one landing call and three double-deck elevators, i.e. six cars to serve it, then the size of the search expanse, i.e. the number of combinations of control decisions will be six different alternatives.

The size of the search expanse depends on various types of limitations, such as settings locking out certain floors, which are used to alter the ability of the elevators to serve different floors in the building at different times of the day. In this case the elevators in question reduce the size of the search expanse, i.e. the number of alternative solutions. The size of the search expanse is also limited by different types of multi-deck strategy that the customer can use to define the manner in which the multi-deck elevators are to be operated. Some of the multi-deck elevators may be used e.g. as shuttle elevators and some as a sort of subgroups to serve different parts or zones of the building.

Thus, the search expanse is used to inform the decision-making mechanism about the service capability of the elevators. Optimisation in the search expanse is performed by means of a genetic algorithm by developing a set of control decisions towards an optimal solution. Each alternative solution generated by the genetic algorithm is input to an elevator model, which may comprise single-deck, double-deck or triple-deck elevator models, depending on the elevator group available. From the elevator model, the fitness of the alternative solutions is returned as a cost value via cost functions back to the genetic algorithm. The cost value or fitness value is used in the optimisation to order the alternative solutions according to fitness when the alternative solutions to be used in the generation of the next population are being selected.

The elevator model comprises general rules of behaviour for the elevator group and the elevators belonging to it in the form of patterns describing e.g. how the passengers generally expect the elevator to behave in serving landing calls and car calls. For example, the elevator must serve all its car calls before it can reverse its direction. In addition to the general rules of behaviour, the elevator model also comprises patterns of interactions between multi-deck cars arising from control actions, such as stopping, opening the car doors, departing from a floor, etc.

The elevator model provides the information needed by the cost functions, which information serves as a basis on which the final fitness of each alternative solution is determined by appropriately weighting different cost factors. The most commonly used cost factors or optimisation criteria include e.g. call and waiting times, which are to be minimised. The user can change the optimisation criteria via a user interface. once an allocation decision that meets certain criteria has been achieved, the elevators in the elevator group are controlled in accordance with this decision.

FIG. 2 illustrates the principle of forming a chromosome for the prevailing traffic situation. This example does not take into account any anticipated landing calls likely to be activated. The starting situation in the building is that there are two landing calls in the up direction and three landing calls in the down direction. All the elevators are standing still without a direction assignment.

The first task is to define the chromosome structure and the search expanse. Since the number of car genes is equal to the number of landing calls, the chromosome will have five car genes. Each elevator is without a direction assignment, so the chromosome will have three direction genes. It is to be noted that since the purpose of a gene is identified by its position. the genes may be placed in optional order. In the figure, the logical gene sequence adopted, starting from the top, is floor-specific landing calls in the up direction, landing calls in the down direction, followed by elevator-specific direction genes. Next to each gene, the figure shows their alleles or the alternative values that each gene may have in this case.

As for the car genes, if each individual car is able to serve the landing call indicated by the gene, the number of alleles will be equal to the total number of cars. Thus, in the elevator group in the figure, the car genes have six alternative values, i.e. cars able to serve. Limitations of service, such as locking settings, are taken into account so that if one of the cars is for some reason unable to serve a landing call, then it will not be included among the alternatives. In the case of direction genes, the number of alleles is two, up and down, except for the terminal floors for the elevators, which may be either physical or logical terminal floors, depending on the configuration of the elevator group regarding service and locking settings.

FIG. 3 elucidates the chromosome structure in the example in FIG. 2 with a few control chromosome realisations, in which one chromosome corresponds to one control decision alternative. The genes are placed in the same sequence in the chromosome. as in FIG. 2, starting from upward landing calls. The content of the car genes in the chromosomes indicate which one of the cars is to serve the landing call corresponding to the gene positior while the direction genes indicate the direction in which each elevator is going to start out to serve landing calls.

As an example, let us have a closer look at the data contained in the first chromosome. According to this chromosome, the first elevator is to serve both of the upward landing calls using its upper car, i.e. car 2. The direction gene for the elevator also indicates the up direction. The second elevator is to serve two of the downward landing calls from the higher floors using its lower car 3, and its direction gene also indicates the down direction. The third elevator in the group is to serve the lowest downward landing call. A cost value descriptive of the fitness of this control action is computed using a double-deck elevator model and a cost function. Although the control decision alternative presented here as an example may seem to be a good one at first sight, evolution of the set of chromosomes may still lead to a better solution. Remember that the best control chromosome obtained after evolution will provide the final control decision for the elevator group.

Genetic multi-deck group control differs from traditional double-deck group control e.g. in that the principle is expressly that the system is adaptable and strives at an optimal solution in the prevailing circumstances by utilising the resources available. Via a pre-programmed user interface, the possibility of setting limitations can be made available to the user as well.

FIG. 4 visualises the flexibility of the controller in respect of service optimisation of the elevator group, in which the customer or the person responsible for smoothness of the traffic in the building can freely develop different ways and strategies for serving the passengers e.g. via a graphic user interface. Thus, the function left to the group controller is to find the best control decision for the momentary traffic situation within the framework of these circumstances. This principle also enables the group controller to immediately respond to changes in the use of the building according to a new service configuration.

FIG. 4 represents an elevator group comprising four double-deck elevators. As seen from left to right in the figure, the first elevator may serve all floors using both of its cars, except for the terminal floors. The second elevator may serve odd floors using its lower car and even floors using its upper car. The third elevator serves the lower part of the building using both of its cars, with the exception of the lowest and highest floors served by it. The service configuration of the fourth double-deck elevator in the group is an example of a shuttle-type implementation, in other words, the elevator serves passengers travelling to or from floors in the middle and top parts of the building. All the elevators work under the same group controller.

In the foregoing, the invention has been described by way of example while different embodiments are possible within the framework of the inventive idea defined by the claims.

What is claimed is:

1. Genetic procedure for the allocation of calls issued via landing call devices of elevators comprised in a multi-deck elevator group, characterised in that a multi-deck elevator model is formed in which the limitations of and rules of behaviour for each elevator in the multi-deck elevator group and each car of each elevator are defined, a plurality of allocation options, i.e. chromosomes are formed, each of which contains a car data item and an elevator direction data item for each active landing call, and these data, i.e. genes, together define a car to serve each landing call as well as a collective control direction for the elevator, for each chromosome, a fitness function value is determined, one or more of the chromosomes are selected, which are then altered in respect of at least one gene, fitness function values are determined for the new chromosomes, the process of altering the chromosomes, selecting chromosomes and determining fitness functions is continued until a termination criterion is met, based on the fitness function values, the most suitable chromosome is selected and the calls are allocated to the elevators and cars in the elevator group in accordance with this solution.

2. Procedure as defined in claim 1, characterised in that cars belonging to the same elevator are associated with each other in the elevator model.

3. Procedure as defined in claim 1, characterised in that, in the multi-deck elevator model, a single-deck elevator model is formed to define the limitations of and rules of behaviour for single-deck elevators belonging to the elevator group.

4. Procedure as defined in claim 1, characterised in that, in the multi-deck elevator model, a double-deck elevator model is formed to define the limitations of and rules of behaviour for double-deck elevators belonging to the elevator group.

5. Procedure as defined in claim 1, characterised in that, in the multi-deck elevator model, a triple-deck elevator model is formed to define the limitations of and rules of behaviour for triple-deck elevators belonging to the elevator group.

6. Procedure as defined in claim 1, characterised in that the chromosomes to be altered are selected on the basis of their fitness function values.

7. Procedure as defined in claim 1, characterised in that the chromosomes are altered by means of a genetic algorithm via selection, hybridisation and/or mutation.

8. Procedure as defined in claim 1, characterised in that the termination criterion is met when a predetermined fitness function value, number of generations, processing time or a sufficient homogeneity of the population is reached.

9. Procedure as defined in claim 1, characterised in that the elevator model defines rules of behaviour for the elevator and the cars belonging to it.

10. Procedure as defined in claim 1, characterised in that the limitations consist of the number of elevators available together with respective car sizes and degrees of occupancy, locking settings concerning car calls and landing calls, and service limitations regarding car calls and landing calls, imposed on the elevator cars due to different group control modes and strategies.

11. Procedure as defined in claim 1, characterised in that the number of car genes in the chromosome varies from one instant to the next according to the number of landing calls active.

12. Procedure as defined in claim 1, characterised in that a direction gene for the elevator is added to the chromosome when no collective control direction has been assigned to the elevator.

13. Procedure as defined in claim 1, characterised in that the number of car genes in the chromosome is influenced by anticipating landing calls likely to be received in the near future.

* * * * *